US006752685B2

(12) United States Patent
Ulrich et al.

(10) Patent No.: US 6,752,685 B2
(45) Date of Patent: Jun. 22, 2004

(54) ADAPTIVE NOZZLE SYSTEM FOR HIGH-ENERGY ABRASIVE STREAM CUTTING

(75) Inventors: Robert Ulrich, Ham Lake, MN (US); Eric K. Pritchard, Berkeley Springs, WV (US)

(73) Assignee: Lai East Laser Applications, Inc., Westminster, MD (US)

( * ) Notice: Subject to any disclaimer, the term of this patent is extended or adjusted under 35 U.S.C. 154(b) by 74 days.

(21) Appl. No.: 10/109,865

(22) Filed: Apr. 1, 2002

(65) Prior Publication Data

US 2002/0151250 A1 Oct. 17, 2002

Related U.S. Application Data

(60) Provisional application No. 60/282,919, filed on Apr. 11, 2001.

(51) Int. Cl.[7] ..... B24B 1/00

(52) U.S. Cl. ..... 451/2; 451/36; 451/38; 451/40; 451/102; 451/90

(58) Field of Search ..... 451/36–40, 90, 451/61, 102; 239/434, 587.6, 584

(56) References Cited

U.S. PATENT DOCUMENTS

| | | | |
|---|---|---|---|
| 3,109,262 | A | 11/1963 | Weaver et al. |
| 3,428,257 | A | 2/1969 | Kentfield et al. |
| 3,510,065 | A | 5/1970 | Gigantino et al. |
| 3,576,222 | A | 4/1971 | Acheson et al. |
| 3,737,108 | A | 6/1973 | Stumphauzer et al. |
| 3,796,371 | A | 3/1974 | Taylor et al. |
| 3,843,055 | A | 10/1974 | Nord et al. |
| 4,236,674 | A | 12/1980 | Dixon |
| 4,346,848 | A | 8/1982 | Malcolm |
| 4,471,913 | A | 9/1984 | Hofmann |
| 4,555,872 | A | 12/1985 | Yie |
| 4,587,772 | A | 5/1986 | Griffiths |

(List continued on next page.)

*Primary Examiner*—George Nguyen
(74) *Attorney, Agent, or Firm*—Rosenberg, Klein & Lee

(57) ABSTRACT

A system is provided for delivering onto a workpiece a high-energy abrasive cutting stream. The system generally comprises a head assembly for providing a pressurized fluidic stream; a nozzling unit coupled to the head assembly for nozzling the pressurized fluidic stream; and, an adaptive orientation assembly coupled to the nozzling unit. The nozzling unit is operable to expel a high-energy abrasive cutting stream for cutting about or along a predefined pattern on the workpiece, and includes a nozzle member having a laminar inner wall surface defining a longitudinally extending passage. This passage terminates at an outlet portion which describes in sectional contour a predetermined shape such that, during operation, it serves to generate upon the workpiece an instantaneous kerf of cut having a corresponding sectional contour. The adaptive orientation assembly is operable to displace the nozzle member in a manner adaptive to the position of the nozzling unit relative to the pattern predefined on the workpiece. The adaptive orientation assembly thus maintains the cutting stream within a predefined angular orientation range relative to predefined pattern.

31 Claims, 10 Drawing Sheets

U.S. PATENT DOCUMENTS 4,627,573 A 12/1986 Havens et al.
4,669,760 A 6/1987 Hashish et al.
4,708,214 A 11/1987 Krawza et al.
4,711,056 A 12/1987 Herrington et al.
4,776,412 A 10/1988 Thompson
4,805,839 A 2/1989 Malek
4,817,874 A 4/1989 Jarzebowicz
4,819,388 A 4/1989 Kirkland
4,848,671 A 7/1989 Saurwein
4,854,091 A 8/1989 Hashish et al.
4,913,353 A 4/1990 Myers
4,936,059 A 6/1990 Hashish et al.
4,951,429 A 8/1990 Hashish et al.
4,957,242 A 9/1990 Schadow et al.
5,018,317 A 5/1991 Kiyoshige et al.
5,018,670 A 5/1991 Chalmers
5,046,668 A 9/1991 Ikeuchi et al.
5,052,624 A 10/1991 Boers et al.
5,054,249 A 10/1991 Rankin
5,060,869 A 10/1991 Bekius
5,092,085 A 3/1992 Hashish et al.
5,144,766 A 9/1992 Hashish et al.
5,170,946 A 12/1992 Rankin
5,209,406 A 5/1993 Johnson
5,209,446 A 5/1993 Kawai
5,320,289 A 6/1994 Hashish et al.
5,341,608 A 8/1994 Mains, Jr.
5,365,816 A * 11/1994 Rudy ..... 83/177
5,390,450 A 2/1995 Goenka
5,469,768 A 11/1995 Schumacher
5,494,124 A 2/1996 Dove et al.
5,551,909 A 9/1996 Bailey
5,607,109 A 3/1997 Von Berg
5,626,508 A 5/1997 Rankin et al.
5,704,825 A 1/1998 LeCompte
5,765,578 A * 6/1998 Brandt et al. ..... 134/7
5,782,673 A 7/1998 Warehime
5,785,258 A 7/1998 Akin et al.
5,785,582 A * 7/1998 Stefanik et al. ..... 451/102
5,851,139 A 12/1998 Xu
5,860,849 A 1/1999 Miller
5,868,323 A 2/1999 Cantor
5,878,966 A 3/1999 Asakawa et al.
5,881,558 A 3/1999 Kawahara et al.
5,881,958 A 3/1999 Asakawa et al.
5,921,476 A 7/1999 Akin et al.
5,975,431 A 11/1999 Harita et al.
5,992,404 A 11/1999 Bleyer et al.
5,992,763 A 11/1999 Smith et al.
6,012,653 A 1/2000 Gunther et al.
6,036,116 A 3/2000 Bui
6,062,957 A 5/2000 Klaft et al.
6,065,683 A 5/2000 Akin et al.
6,077,152 A 6/2000 Warehime
6,119,964 A 9/2000 Lombari
6,123,413 A 9/2000 Agarwal et al.
6,126,524 A 10/2000 Shepherd
6,155,245 A * 12/2000 Zanzuri ..... 125/12
6,161,781 A 12/2000 Kojima et al.
6,168,503 B1 1/2001 Pao et al.
6,280,302 B1 8/2001 Hashish et al.
6,283,832 B1 9/2001 Shepherd
6,293,857 B1 9/2001 Allard
6,425,805 B1 * 7/2002 Massa et al. ..... 451/40
6,530,823 B1 * 3/2003 Ahmadi et al. ..... 451/39

* cited by examiner

ADAPTIVE NOZZLE SYSTEM FOR HIGH-ENERGY ABRASIVE STREAM CUTTING

RELATED U.S. APPLICATION DATA

This Application is based on U.S. Provisional Patent Application, Serial No. 60/282,919, filed Apr. 11, 2001.

BACKGROUND OF THE INVENTION

1. Field of the Invention

The subject adaptive high-energy abrasive stream cutting system is generally directed to a system for performing high definition cutting or abrading of a workpiece. More specifically, the subject adaptive high-energy abrasive stream cutting system is one which delivers onto a workpiece a high energy abrasive cutting stream to form therein an instantaneous kerf of cut having a predetermined shape. It is a system which forms and optimally maintains the angular orientation of the instantaneous kerf of cut during the abrasive cutting stream's cutting of or about a predefined pattern defined on the workpiece.

Various types of systems are known in the art which utilize abrasive fluidic streams to cut or abrade predefined patterns in or through even very hard and tough materials, like dense stone and steel, which are normally quite difficult to cut, let alone to precisely contour. Unlike sandblasting and other such types of systems for effecting broad surface treatment, high definition cutting systems generate highly focused, extremely pressurized fluidic cutting streams in order, for example, to very closely trace intricate prescribed patterns upon a workpiece. Given enough cutting pressure, highly intricate patterns can effectively be 'carved' into even the hardest of workpiece materials using such systems.

Typically in those systems, a head assembly receives and pressurizes a stream of water or other suitable fluid material provided by a given source. The pressurized stream is then further pressurized by forced passage through a nozzling mechanism whereupon a suitably abrasive particulate material is drawn into the stream at a controlled concentration for commingled expulsion therewith onto a workpiece. The energy and resulting abrasiveness of the cutting stream thus expelled is sufficiently high to cut into—and if desired, through—the workpiece material. The abrasive cutting stream may thereafter be displaced along the workpiece to trace and cut one or more predefined patterns.

Common drawbacks to these systems and their numerous applications are many, however—not the least of which are the inefficient consumption of the energy harnessed in the cutting stream, and the inability to effectively accommodate cuts of varying intricacy along a given pattern. In such known systems for precise workpiece cutting applications, little if any attention has been placed upon the sectional contour of the generated high-energy abrasive cutting stream. Consequently, no significant effort has heretofore been made—at least not in cutting applications—to employ an abrasive stream shaped in sectional contour to anything other than a standard, substantially circular shape. Except where the pattern to be cut presents a circular concavity along the path of cut, then, presently known cutting systems invariably incur substantial waste in the generated stream's cutting energy.

Where the cutting stream incorporates an abrasive particulate material, such known cutting systems wastefully consume greater amounts of the abrasive particulate material than necessary. Since the abrasive particulate material tends to be well dispersed throughout the cutting stream when entrained therein, the particulate material unnecessarily occupies that portion of the cutting stream failing to contribute a meaningful cut. Over the duration of an extended cutting process, the waste could accumulate to considerable amounts.

The resulting inefficiency is illustrated in FIGS. 10*a* and 11*a*, which show a circular stream section 1000 disposed in cutting position along variously configured peripheries 1100, 1120 of a pattern to be cut. The tangency of contact between the stream 1000 and the straight periphery 1100 necessarily limits the actual cutting action along the periphery 1100 to just the stream's immediately proximate portion 1010. Where the object is simply a precise cut along this straight periphery 1100, then, it is only the immediately proximate portion 1010 of the stream 1000 which forms a cut of any real consequence. Unless the object includes cutting a particularly configured gap to immediately bound the pattern being cut, for instance, the cutting power of the stream's remaining distal portions 1020 is essentially wasted. The stream's wasted cutting power is all the more evident in FIG. 11*a* where the tangency of contact between the stream 1000 and the cut pattern's periphery 1120 is accentuated by the convexity of this periphery 1120.

FIG. 12*a* illustrates other difficulties often encountered in the use of systems heretofore known when even a nominally intricate cut pattern 1140 is prescribed. Where, as illustrated, the prescribed cut pattern 1140 includes such features as a recessed periphery 1140*a*, the same cutting stream configuration used elsewhere along the cut pattern may not suffice in cutting the recess 1150 delineated by periphery 1140*a*. While the cutting stream 1000 may adequately cut along the pattern's base periphery 1140*b*, it exceeds in diameter the width of the recess 1150 to be cut. It may be necessary in such instance, perhaps, to halt operation and make the required modifications to generate a finer cutting stream 1000' before the recessed periphery 1140*a* could be fully cut. This may require a certain degree of re-tooling in many cases.

Given such impediments, high definition cutting of precisely defined workpiece patterns remains a considerable challenge in the art. Even where ample resources to eventually effect a precise cut and finish about intricately detailed patterns, the indiscriminate use of an abrasive cutting stream having a fixed sectional configuration and the retention of that abrasive cutting stream at fixed angular orientation during operation, often render the process unduly inefficient and labor/time intensive—prohibitively so, in some cases.

2. Prior Art

High energy abrasive stream cutting systems are known in the art, as are assemblies which define and expel a non-circularly shaped abrasive stream. The best prior art references known include: U.S. Pat. Nos. 3,109,262; 3,576,222; 4,555,872; 4,587,772; 4,669,760; 4,708,214; 4,711,056; 4,776,412; 4,817,874; 4,819,388; 4,848,671; 4,854,091; 4,913,353; 4,936,059; 4,957,242; 5,018,317; 5,018,670; 5,052,624; 5,054,249; 5,092,085; 5,144,766; 5,170,946; 5,209,406; 5,320,289; 5,469,768; 5,494,124; 5,584,106; 5,782,673; 5,785,258; 5,851,139; 5,860,849; 5,878,966; 5,881,958; 5,921,476; 5,992,763; 6,065,683; and 6,077,5152.

Such prior art references, however, fail to provide any system in which a high energy abrasive stream for precise cutting of predefined workpiece patterns is sufficiently shaped and angularly displaced in adaptive manner during operation. Where the abrasive stream is modified in form to something other than a circular or other such fixed sectional contour, the abrasive stream in known systems is invariably modified either for conditioning/treating the workpiece surface or for removing wide areas of workpiece material, not for precision cutting. The stream is, therefore, modified in those systems primarily for dispersive effect. Hence, there remains a need for a system which removes the considerable inefficiency and imprecision inhering in high-energy abrasive stream cutting systems heretofore known.

SUMMARY OF THE INVENTION

A primary object of the present invention is to provide a system for generating an abrasive cutting stream operable to cut about or along a predefined pattern on a workpiece in an energy efficient manner.

It is another object of the present invention to provide a system for generating and adaptively maintaining at an optimal angular orientation a high energy abrasive cutting stream which is displaced in accordance with a predefined cutting pattern.

It is yet another object of the present invention to provide a system whose cutting stream generates a kerf of cut having in sectional contour a preselected one of a plurality of predetermined shapes suitable to effect a precisely contoured cut along a pattern predefined on a workpiece.

These and other objects are attained by the subject system for delivering onto a workpiece a high energy abrasive cutting stream. The system generally comprises a head assembly for providing a pressurized fluidic stream; a nozzling unit coupled to the head assembly for nozzling the pressurized fluidic stream; and, an adaptive orientation assembly coupled to the nozzling unit. The nozzling unit is operable to expel a high energy abrasive cutting stream for cutting about or along a predefined pattern on the workpiece, and includes a nozzle member having a laminar inner wall surface defining a longitudinally extending passage. This passage terminates at an outlet portion which describes in sectional contour a predetermined shape such that, during operation, it serves to generate upon the workpiece a kerf of cut having a corresponding sectional contour. The adaptive orientation assembly is operable to displace the nozzle member in a manner adaptive to the position of the nozzling unit relative to the pattern predefined on the workpiece. The adaptive orientation assembly thus maintains the cutting stream within a predefined angular orientation range relative to predefined pattern.

In a preferred embodiment, the system also comprises an articulation assembly coupled to the nozzling unit for pivotally displacing the nozzle member about at least one transversely directed pivot axis during the relative displacement of the nozzling unit and workpiece one relative to the other. Also in a preferred embodiment, the system further comprises a controller coupled to the adaptive orientation assembly for automatically actuating the adaptive angular displacement of the nozzle member. The predetermined shape employed for the nozzle member passage outlet portion may include such non-circular shapes as square, rectangular, curved rectangular, elliptic, segmented annular, diamond-like, oval, oblong, curved oblong, teardrop-like, and keyhole-like shapes.

DETAILED DESCRIPTION OF THE PREFERRED EMBODIMENTS

Figure 1A:
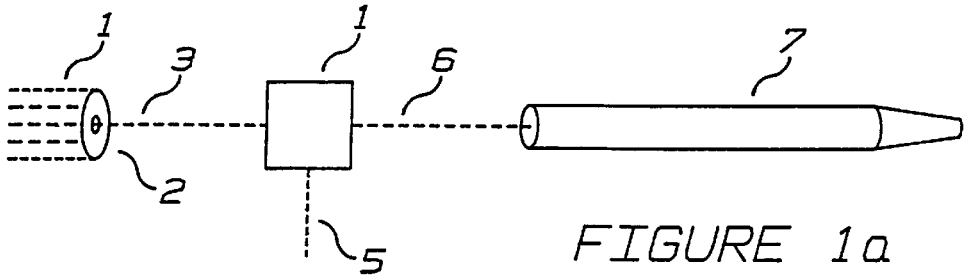
FIGURE 1a PRIOR ART
FIG. 1*a* is a schematic diagram schematically illustrating a high energy abrasive stream cutting system known in the prior art.
Figure 1B:
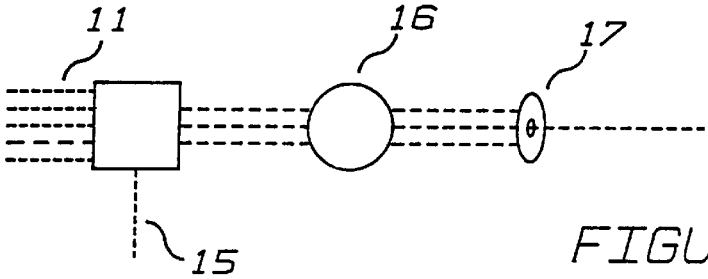
FIGURE 1b PRIOR ART
FIG. 1*b* is a schematic diagram schematically illustrating a variation of the prior art high-energy abrasive stream cutting system shown in FIG. 1*a;*
Figure 2A:
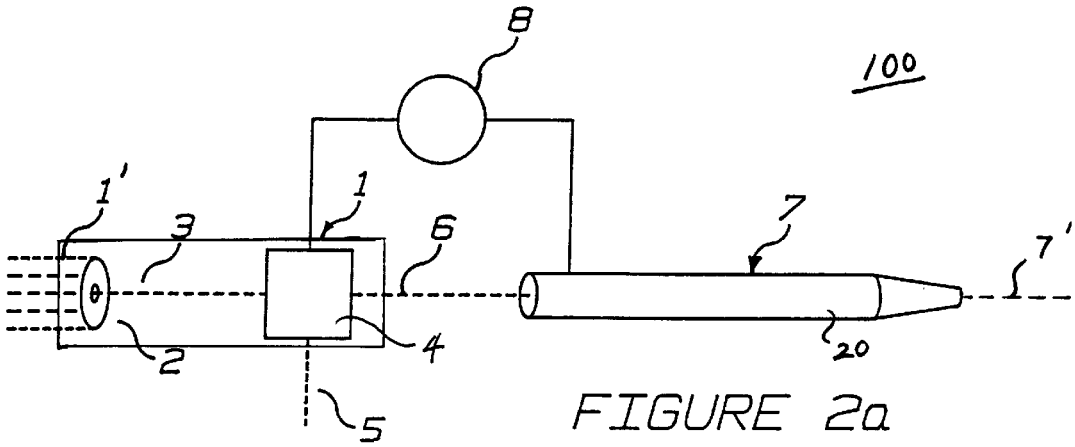
FIG. 2*a* is a schematic diagram schematically illustrating the intercoupling of components in accordance with one embodiment of the present invention.

Referring now to FIG. 2*a*, there is shown a schematic diagram illustrating the intercoupling of components in an adaptive high-energy abrasive stream cutting system 100 formed in accordance with an exemplary embodiment of the present invention. As illustrated, system 100 comprises a head assembly 1 which receives a pressurized liquid or gaseous flow 1' of a fluid material to produce a pressurized fluidic stream 6. System 100 also comprises a nozzling unit 7 which receives the pressurized fluidic stream 6 to expel a high-energy abrasive cutting stream 7' suitably adapted to cut along a predefined pattern on a workpiece. System 100, moreover, comprises an adaptive orientation assembly coupled at least to nozzling unit 7, but preferably to both nozzling unit 7 and head assembly 1, for angularly displacing at least a portion of nozzling unit 7 in a manner adaptive to the position of that nozzling unit 7, or portion thereof, relative to the pattern predefined on the given workpiece.

In broad concept, head assembly 1 includes an orifice-forming portion 2 and a combining portion 4. Orifice-forming portion 2 receives the flow 1' of pressurized fluid and forms an intermediate stream 3 augmented in pressure for introduction into combining portion 4. Combining portion 4 receives that intermediate stream 3 and preferably combines therewith an abrasive particulate material (such as finely ground garnet) introduced via a passage 5. Preferably, combining portion 4 thus serves as a mixing chamber which that generates a pressurized, abrasive particle-laden, fluidic stream 6 for entry into nozzling unit 7. Nozzling unit 7 effects further nozzling of this pressurized fluidic stream 6, concurrently shaping and pressure-augmenting the passing stream to expel a high-energy abrasive cutting stream 7' having a particular sectional contour.

In accordance with the present invention, nozzling unit 7 includes at least one nozzle member 20 having a laminar inner wall surface that defines a longitudinally extending passage, as described in following paragraphs. Nozzle member 20 serves effectively as a focusing tube whose passage is preferably surrounded by a continual inner wall surface of merging geometries, and terminates at an outlet portion that describes in sectional contour a preselected one of a plurality of predetermined shapes for generating in the workpiece an instantaneous kerf of cut of corresponding shape. Such instantaneous kerf of cut is defined herein to represent the cut a cutting stream would describe when incident upon a workpiece plane, and unless otherwise noted, all references to "kerf" hereinafter denote such instantaneous kerf of cut. In any event, the kerf generated by nozzle member 20 is prescribed so as to be optimally suited for the intended application. As the sectional contour of the passage outlet portion—and therefore the sectional contour of its kerf—may very well be non-circular, nozzle member 20 is angularly displaced as needed, preferably about its axis, by adaptive orientation assembly 8.

While in the simplest applications, it may be kept stationary; the abrasive cutting stream 7' generated in many applications is displaced along the workpiece in tracing along a particular pattern prescribed thereon. The concurrent angular displacement of nozzle member 20 in a manner adaptive to the cutting stream's advancement along the prescribed pattern's contour serves to maintain the cutting stream's kerf of cut at an optimal angular orientation relative to the particular portion of the prescribed pattern then being traced. This is graphically illustrated in FIGS. 10*b*, 11*b*, and 12*b*.

Figure 4A:
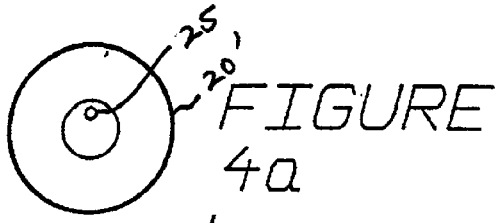
FIGS. 4*a*–4*p* are bottom plan views of further exemplary embodiments for a nozzle member employed in accordance with one aspect of the present invention.
Figure 4B:
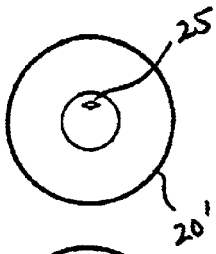
Figure 10A:
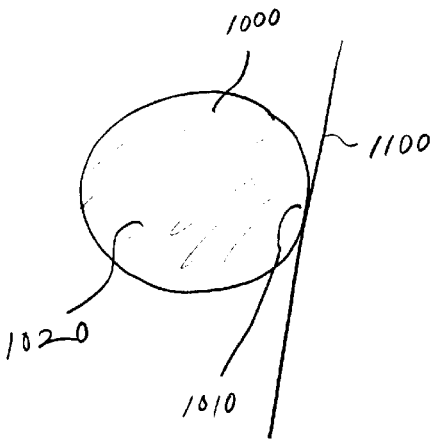
FIG. 10a PRIOR ART
FIG. 10*a* is an illustrative diagram illustratively depicting a contouring cut as may be effected by a high-energy abrasive stream cutting system known in the prior art.
Figure 11A:
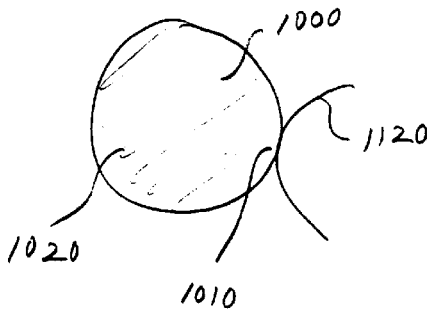
FIG. 11a PRIOR ART
FIG. 11*a* is an illustrative diagram illustratively depicting another contouring cut as may be effected by a high-energy abrasive stream cutting system known in the prior art.
Figure 12A:
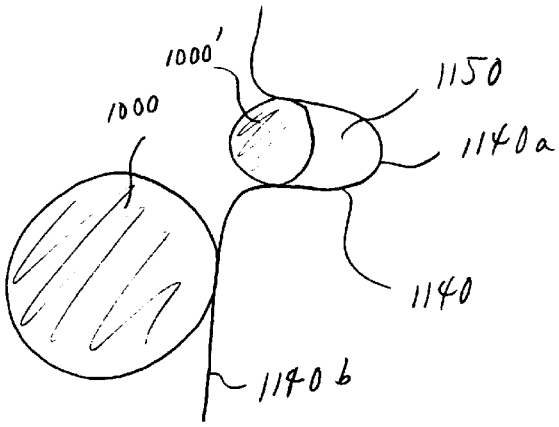
FIG. 12a PRIOR ART
FIG. 12*a* is an illustrative diagram illustratively depicting yet another contouring cut as may be effected by a high-energy abrasive stream cutting system known in the prior art; and, FIG. 12*b* is an illustrative diagram illustratively depicting a contouring cut similar to that shown in FIG. 12*a*, as may be effected by a system implemented in accordance with still another embodiment of the present invention.
Figure 10B:
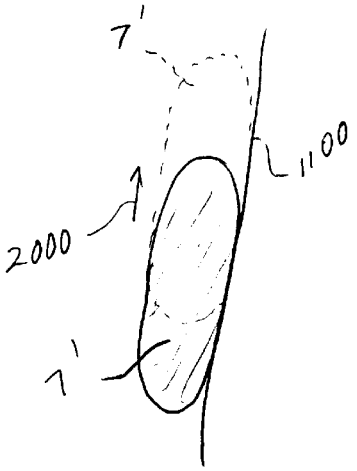
FIG. 10*b* is an illustrative diagram illustratively depicting a contouring cut similar to that shown in FIG. 10*a*, as may be effected by a system implemented in accordance with one embodiment of the present invention.
Figure 11B:
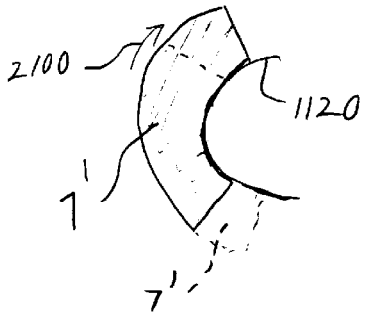
FIG. 11*b* is an illustrative diagram illustratively depicting a contouring cut similar to that shown in FIG. 11*a*, as may be effected by a system implemented in accordance with another embodiment of the present invention.
Figure 12B:
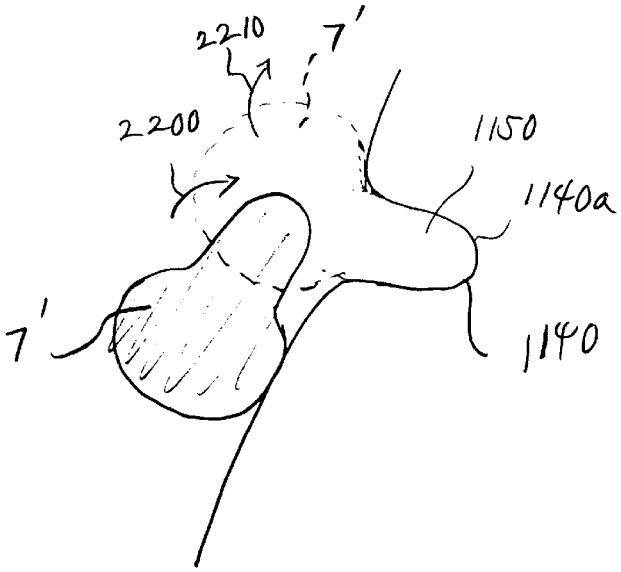

With comparative reference back to FIGS. 10*a*, 11*a*, 12*a*, which illustrate the challenges of efficiently cutting along respective pattern peripheries 1100, 1120, 1140, FIGS. 10*b*, 11*b*, and 12*b* illustrate the significantly improved cutting efficiency realized in accordance with the present invention, when suitable ones of the exemplary shaped nozzle members disclosed herein are utilized. Note that the oblong shaped cutting stream generated by the given nozzle member (such as shown in FIG. 4*i*) would 'spread' the cutting energy of the cutting stream 7' to generate a considerably greater instantaneous cut along the pattern periphery 11100 than in the comparable cutting instance shown in FIG. 10*a*. In the specific cutting instance of FIG. 10*b*, the adaptive angular displacement required for the cutting stream 7' would be minimal, so long as it is advanced along a substantially straight periphery 1100, as indicated by the directional arrow 2000.

Figure 4C:
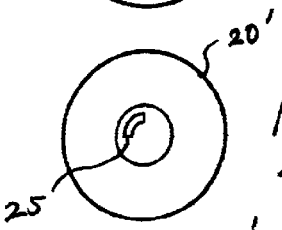
Figure 4D:
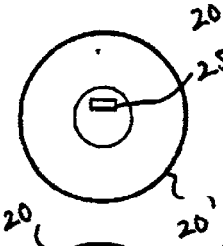
Figure 4E:
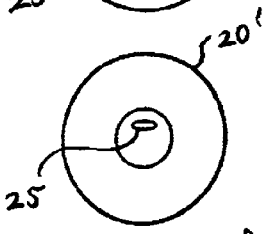
Figure 4F:
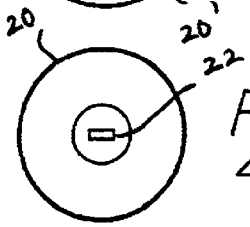
Figure 4G:
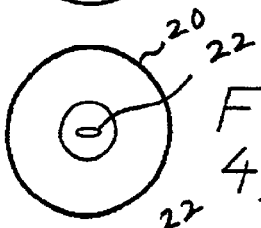
Figure 4H:
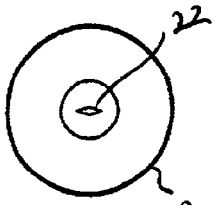
Figure 4I:
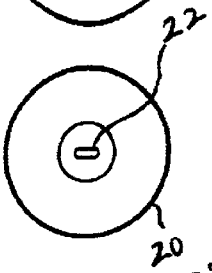
Figure 4J:
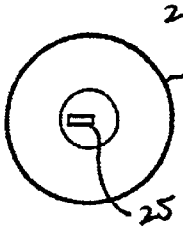
Figure 4K:
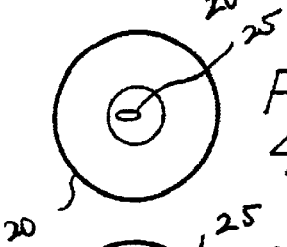
Figure 4L:
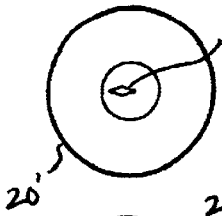
Figure 4M:
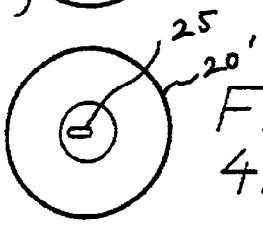

In the cutting instance of FIG. 11*b*, the curved rectangular, or segmented annular, shaped cutting stream generated by the given nozzle member (such as shown in FIG. 4*c*) would similarly 'spread' the cutting energy of the cutting stream 7' to generate a considerably greater instantaneous cut along the pattern periphery 1120 than in the comparable cutting instance shown in FIG. 11*a*. In this instance, an adaptively concurrent clockwise angular displacement of the nozzle member as it advances along the periphery 1120 would yield the combined displacement indicated by the directional arrow 2100.

Figure 4N:
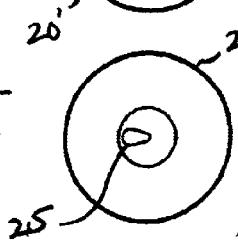
Figure 4O:
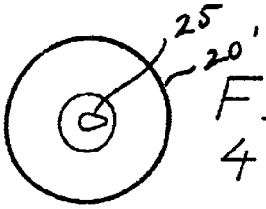
Figure 4P:
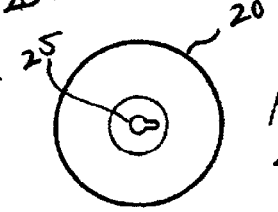

In the cutting instance of FIG. 12*b*, the keyhole-like shaped cutting stream generated by the given nozzle member (such as shown in FIG. 4*p*) would likewise 'spread' the cutting energy of the cutting stream 7' to generate a considerably greater instantaneous cut along the pattern periphery 1140 than in the comparable cutting instance shown in FIG. 12*a*. The nozzle member in this instance would also be angularly displaced in the clockwise direction as cutting stream 7' advances along the periphery 1140 and encounters the abrupt recess 1150 defined by portion 1140*a*. The nozzle member's combined linear and angular displacement would be as indicated by the directional arrow 2200 until the recess 1150 is fully cut, whereupon a combined linear and angular displacement indicated by the directional arrow 2210 would then cause the cutting stream 7' to be withdrawn from the recess 1150 to continue its advancement along the remaining portions of the periphery 1140.

The cutting efficiency thus realized in accordance with the present invention offers a number of considerable practical benefits. First, much of the useful cutting energy available in the given cutting stream is productively applied—to cut at/about the pattern being cut, rather than to form an incidental cut away from the pattern. Much of the abrasive particulate material entrained in the cutting stream is likewise productively applied as a result; and, considerable savings in the amount of such abrasive particulate material consumed may be realized over the duration of a cutting process.

Referring back to FIG. 2*a*, adaptive orientation assembly 8 is automatically controlled, preferably, by a controller (having one or more processing, preprocessing or other such devices) programmably configured in a manner suitable for the intended application. As described in following paragraphs, such controller may include a computer numerical control (CNC) machine by which the abrasive cutting stream 7' may be concurrently displaced in coordinated manner along/about a plurality of predefined axes. Adaptive orientation assembly 8 itself preferably includes a motor-driven mechanism, which imparts to nozzle member 20 of nozzling unit 7 the forces necessary to effect its adaptive angular displacement.

Figure 2B:
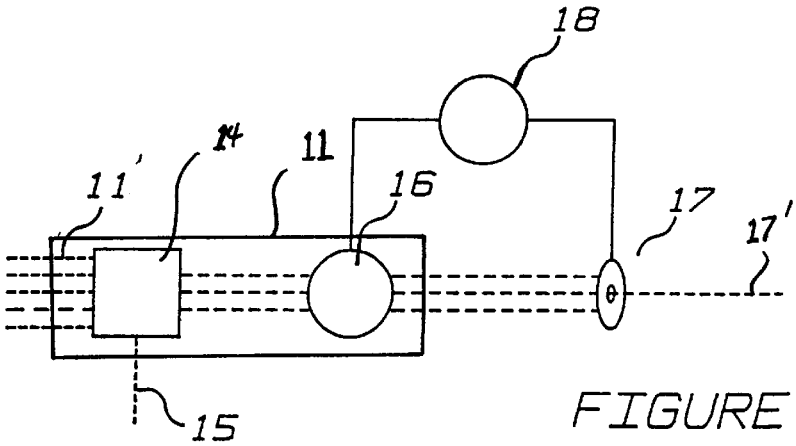
FIG. 2*b* is a schematic diagram schematically illustrating the intercoupling of components in accordance with an alternate embodiment of the present invention.

Referring to FIG. 2*b*, there is shown a schematic diagram illustrating the intercoupling of components in accordance with an alternate embodiment of the present invention. Head assembly 11 includes in this embodiment a combining portion 14 which directly receives an input pressurized stream 11' of liquid or gaseous fluid material and mixes therewith an abrasive particulate material received via a passage 15. Combining portion 14 forms an intermediate stream that enters a pump portion 16 which—using any suitable means known in the art pumps the received intermediate stream through an orifice component 17 to expel a high-energy abrasive cutting stream 17'. An adaptive orientation assembly 18 is operably coupled to head assembly 11 and orifice component 17, as before, to angularly displace all or part of orifice component 17 as necessary to maintain the cutting stream 17' at an optimum orientation relative to the predefined pattern as the stream is linearly advanced therealong.

Orifice component 17 constitutes simply a form of nozzle member 20. While comparatively truncated in axial extent, orifice component is formed nonetheless to define a passage extending axially therethrough, whose outlet portion is sectionally contoured to describe a suitable one of a plurality of predetermined shapes. As in nozzle member 20, this shaped passage outlet portion enables orifice component 17 to produce a correspondingly shaped kerf of cut in the given workpiece. It is to be understood that the cutting stream shaping and other features described herein with reference to embodiments employing the nozzle member structure shown are fully applicable to alternate embodiments employing an orifice component.

Regarding head assembly 1, 11, its configuration is determined in light of the particular requirements and available resources of the intended application. Such details as the specific choice of means by which to initially augment the pressure of the input fluid stream 1', 11', the choice of fluid material for that stream 1', 11', and how much—if any—abrasive particulate material is entrained within the fluidic stream are determined based upon such considerations as the thickness and material composition of the workpiece, the depth of the cut to be made into or through the workpiece, the fineness of detail in the pattern to be cut, and the like. It is conceivable in certain applications that the pressurized fluidic stream of a particular fluid material may, even without the addition of any solid abrasive material, suffice to cut a predefined pattern in a given workpiece.

As described more clearly in the following paragraph, system 100 includes suitable supporting structural features (such as shown in FIGS. 5, 6, 7, and 9) for secure and stable, yet angularly displaceable, support of at least nozzle member 20 (or orifice component 17) of the nozzling unit in unimpeded manner. Preferably, the angular displacement of nozzle member 20 (or orifice component 17) is effected about its longitudinal axis; and, the surrounding structure is without any obstructive or restraining connections and the like which might otherwise hinder this angular displacement during system operation.

Figure 3C:
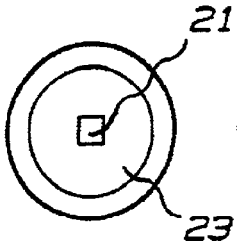
FIG. 3*c* is a top plan view of the exemplary embodiment of a nozzle member shown in FIGS. 3*a* and 3*b;*

In accordance with the present invention, the passage of nozzle member 20 may be formed to define any predetermined sectional contour particularly suited as described herein to cut the pattern prescribed. Referring to FIGS. 3*a*–3*c*, there is shown an exemplary nozzle member 20 formed with a longitudinal passage 27 extending from an inlet portion 21 to an outlet portion 22, which describes an exemplary one of such predetermined sectional contours, a square. Nozzle member 20 in this embodiment includes a tapered stream entrance 23 which extends to inlet portion 21 of passage 27. The intermediate portion of passage 27 connecting inlet and outlet portions 21, 22 is defined by inner wall surface portions which are sufficiently laminar to enable the abrasive fluidic stream's substantially uninterrupted and streamlined flow therethrough. That is, the inner wall surface portions formed about passage 27 are, at least along the flow direction, smoothly contoured, without any abrupt transitions or other structural discontinuities which would obstruct or otherwise disturb the fluidic stream's flow. Passage 27 is thus formed in preferred embodiments by a surrounding continual inner wall surface of merging geometries to realize a smooth linear flow therethrough which yields the preservation of maximum horsepower in the given cutting/machining application.

In the embodiment shown, inlet and outlet portions 21, 22 of passage 27 are congruent in shape, both having the exemplary square sectional shape. In accordance with the present invention, however, inlet and outlet portions 21, 22 may alternatively be formed with incongruent shapes, so long as the transition in sectional contour within the intermediate passage portion between inlet and outlet portions 21, 22 occurs in suitably gradual manner.

Note that in this embodiment, passage 27 extends in substantially coaxial manner relative to the longitudinal axis X of nozzle member 20. In other embodiments such as shown in FIGS. 3*d*–3*f*, however, passage 27 may alternatively extend in non-coaxial manner within nozzle member 20.

Figure 3F:
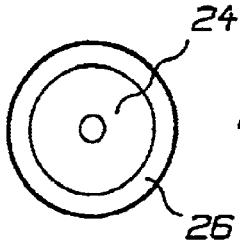
FIG. 3*f* is a top plan view of the exemplary embodiment of a nozzle member shown in FIGS. 3*d* and 3*e;*
Figure 3B:
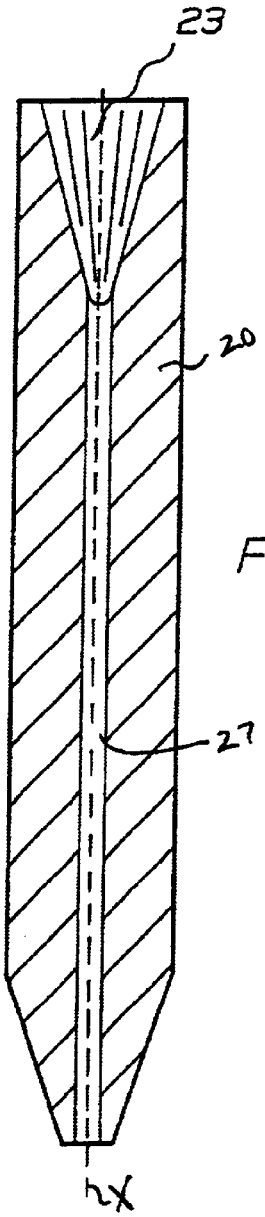
FIG. 3*b* is an elevational view of the exemplary embodiment of a nozzle member shown in FIG. 3*a;*
Figure 3E:
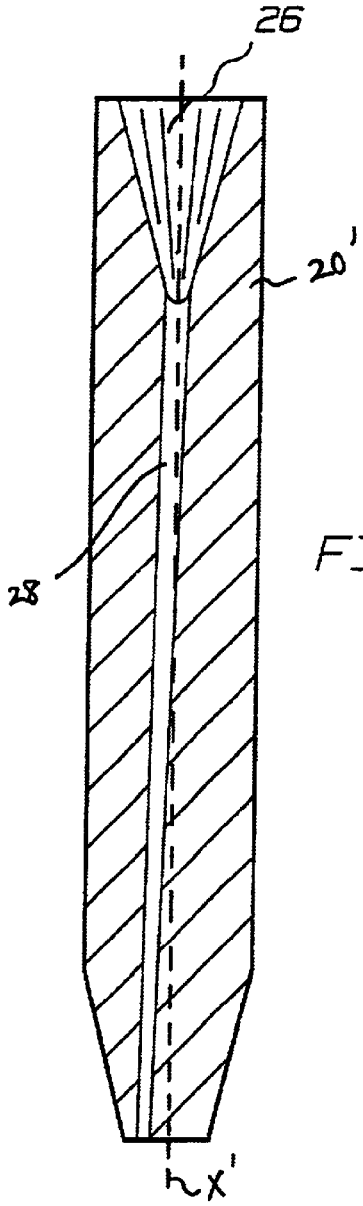
FIG. 3*e* is an elevational view of the exemplary embodiment of a nozzle member shown in FIG. 3*d;*
Figure 3A:
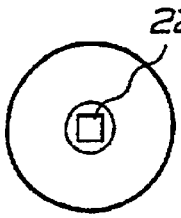
FIG. 3*a* is a bottom plan view of an exemplary embodiment of a nozzle member employed in accordance with one aspect of the present invention.
Figure 3D:
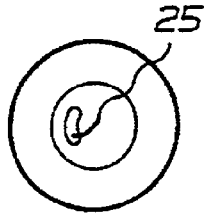
FIG. 3*d* is a bottom plan view of another exemplary embodiment of a nozzle member employed in accordance with one aspect of the present invention.

Referring to the exemplary embodiment of FIGS. 3*d*–3*f*, nozzle member 20' is shown with a configuration particularly well suited for a trepanning-type application. As such, nozzle member 20' is formed much like nozzle member 20 of FIGS. 3*a*–3*c*, with a passage 28 extending from a tapered stream entrance end 26 between inlet and outlet portions 24, 25, but with outlet portion 25 describing an exemplary curved oblong sectional shape and radially offset from the longitudinal axis X'. Passage 28 is thus defined to extend non-coaxially with respect to axis X' by a laminar inner wall surface that accordingly transitions along its length from the circular shape at inlet portion 24 to the curved oblong shape at outlet portion 25.

The fluidic stream pressures generated in cutting applications range has high as operational factors (like the material composition of the workpiece being cut, the speed at which the cut is to be effected, and the material composition of the cutting stream employed) will practically permit. Typical ranges are found to be on the order of 50,000 to 100,000 psi. Consequently, nozzle member 20, 20' is preferably formed of a steel or other comparable material having sufficient strength, hardness, and other properties to withstand without premature wear the high pressures and other extreme environmental conditions to be encountered in the intended application.

While FIGS. 3*a*–3*f* illustrate exemplary configurations for an elongate nozzle member structure, an orifice component considerably more abbreviated in length than the structure shown may be employed in alternate embodiments, as mentioned with reference to FIG. 2*b*. Being without the degree of graduated constriction afforded by the extended length of nozzle member 20, 20', however, such an orifice component must withstand comparatively greater fluidic stream pressures. A suitable orifice component is thus preferably formed of a material correspondingly greater in wear resistance. For example, diamond or other material of comparable wear resistance may be employed in those alternate embodiments.

Passage 28 may be formed in nozzle member 20, 20' using any suitable process known in the art capable of generating the precise, smoothly transitioned shape of passage 28. Given the high pressures encountered over extended periods of time in normal operation, nozzle member 20, 20' is preferably of an integrally formed construction—seams, joints, and the like potentially compromising its structural integrity in typical applications.

Referring back to the nozzle member embodiments shown in FIGS. 3*a*–3*f*, the inner walls of nozzle member 20, 20' which define the shape of passage 27, 28 serve inherently to distribute the energy of the abrasive material laden stream passing therethrough, doing so preferably in a manner ideally suited to the task at hand. Generally, abrasive cutting entails one or a combination of several basic tasks: forming a perforate cut and forming a linearly extended cut (straight or curvilinear). Inasmuch as different bits may be configured in wood or metalworking for respective drilling and contouring applications, variously configured nozzle members respectively suited for effective drilling and contouring type cutting applications may be analogously realized in accordance with the present invention. The predetermined sectional shape selected for a given nozzle member ensures that much if not all of the cutting stream expelled thereby is continually maintained such that it contributes a meaningful cut of the workpiece.

The inner passage of a nozzle member having the structure shown is invariably much greater in its length dimension than in its diametric dimension. Even where passage 28 deviates, as illustrated in FIG. 3*e*, from the nozzle member's center axis X', passage 28 remains effectively parallel to axis X', and to the axis about which the nozzle member 20' is angularly displaced during system operation. The potential distortion of the resulting kerf of cut (due to the less than perfectly normal incident cutting stream's projection upon the workpiece surface) is found in most applications to be quite negligible.

It is preferable, accordingly, that passage 27, 28 of nozzle member 20, 20' be kept as straight as possible, so as to facilitate the smooth, horsepower-efficient flow of abrasive-laden fluidic stream therethrough necessary for producing precisely finished workpiece surfaces. Vortices created by even the slightest of interruptions or disruptions in the flow of the fluidic stream tend to produce excessive turbulence and horsepower losses that lead to ripples in the workpiece surface finish.

Referring now to FIGS. 4*a*–4*e*, there are shown exemplary embodiments of nozzle member 20' showing the outlet portions thereof. FIGS. 4*a*–4*e* respectively disclose nozzle members of the type shown in FIGS. 3*d*–3*f*, and illustrate examples of predetermined shapes that may be employed for outlet portion 25 radially offset from the nozzle member's center axis. FIGS. 4*a*–4*e* respectively illustrate in turn circular, diamond, curved rectangular (or segmented annular), rectangular, and elliptic shapes for outlet portion 25. Outlet portions so configured are particularly well adapted for abrasive drilling and other such operations upon the given workpiece. During such operations, nozzle member 20', hence passage 28 and its outlet portion 25, may be rotated as needed about a rotation axis preferably (though not necessarily) coincident with the nozzle member's center axis, as indicated by the directional arrow 1220 in FIG. 4*c*, in order to adaptively maintain the kerf of cut at the appropriate angular position in relation to the portion of the predefined pattern being cut.

As discussed in preceding paragraphs with respect to FIG. 11*b*, the curved rectangular shape of outlet portion 25 illustratively shown in FIG. 4*c* is particularly useful in efficiently distributing the energy of the cutting stream expelled therefrom along the curve being cut in drilling or trepanning type applications. The curved rectangular shape effectively extends the contact between the cutting stream and curve to be cut from a point of tangency to an angularly extended region. Given the same sectional area, then, the curved rectangular shape of outlet portion 25 deposits significantly more instantaneous cutting energy along a correspondingly contoured cut pattern than would, say, a circular, diamond, or any other shape for the nozzle head's passage outlet portion.

Referring to FIGS. 4*f*–4*m*, there are shown other examples of outlet portion configuration for either nozzle member 20 or 20' shown in FIGS. 3*a*–3*c* and 3*d*–3*f*. These FIGS. 4*f*–4*m* show exemplary configurations particularly adapted for abrasive contouring applications. Shaped generally with a sectional length-to-width dimensional ratio preferably of at least 1.5:1 (as opposed to the 1:1 ratio of a circular shape, for instance), the rectangular, elliptic, diamond, and oblong (rectangular with tapered corners) elongate shapes serve to stretch the cutting stream to a longer and narrower sectional contour than would be generated by a circular outlet portion. This again yields more efficient, precise, and therefore faster contouring cuts of the workpiece. The sectionally elongated, shaped outlet portions 22 of FIGS. 4*f*–4*i* are shown illustratively centered approximately on or about the center axis of nozzle member 20, whereas the correspondingly shaped outlet portions 25 of FIGS. 4*j*–4*p* are shown illustratively projecting radially from the nozzle member's center axis. The position of shaped outlet portion 25 relative to the nozzle member's center axis will depend, much like the sectional shape actually employed for the outlet portion, on the requirements of the cutting task at hand, as well as the actual extension of the axis about which the nozzle member is to be angularly displaced during the cutting operation.

One factor which may determine the extent of the shaped outlet portion's radial offset from the nozzle member's center axis is the software capability available in the given application for automatically controlling nozzle member displacement. The cutter compensation calculations necessary to effect curvilinear cuts tend to be more complex than those necessary to effect to straight linear cuts. Where the nozzle member is to be rotated about its center axis, radially offsetting the shaped outlet portion 25 from that center axis may in some applications lessen the required complexity of those calculations. The outlet portion configurations illustrated in FIGS. 4*j*–4*m*, for example, typically afford the use of unidirectional software control, while the outlet portion configurations illustrated in FIGS. 4*f*–4*i* will typically necessitate the use of bi-directional software control.

Referring to FIGS. 4*n*–4*p*, there are shown further exemplary configurations of outlet portion 25. FIGS. 4*n*–4*p* illustrate, in turn, inversely oriented teardrop (or pear) shaped outlet portions, and a keyhole-shaped outlet portion. The teardrop sectional shapes shown in FIGS. 4*n*, 4*o* positioned as they are, each offset from the nozzle member's center axis, present a highly versatile configuration for outlet portion 25. It is noteworthy that at least for sectional shapes having the same length-to-width ratio, such teardrop sectional shape maximizes the cutting length for a given sectional area of outlet portion 25. Moreover, with its higher radius end disposed as shown in FIG. 4*o* (and FIG. 4*p* for the keyhole-shaped outlet portion), the software control complexities attributable to the other non-circular sectional shapes shown for outlet portion 25 may be reduced to that attributable to a circular sectional shape of comparable radius, by suitably leading in the direction of cut with the higher radius end.

The cutting length attributable to the sectional shape of a given cutting stream is normally defined to be the leading portion of its perimeter, or the peripheral length of that part actually making intimate contact with the workpiece material being cut. The cutting width is normally defined to be the linear transverse extent described by that leading peripheral portion. Then, in applications where the teardrop sectional shape of a type illustrated in FIGS. 4*n*, 4*o* is employed with its narrow end leading the cut, the cutting length enhancement attained over a circularly shaped cutting stream of comparable diametric extent is readily apparent. Whereas the cutting length-to-cutting width ratio for the circular shaped cutting stream reduces to one-half pi (or, ½×circumference/diameter), or approximately 1.57:1; the same ratio for a comparable teardrop shaped cutting stream led by its narrow end is found to be significantly greater, on the order of approximately 2.72:1 in preferred embodiments. Of course, a teardrop shape extended either more or less in length would yield a correspondingly greater or correspondingly lesser cutting length-to-cutting width ratio; however, so varying the teardrop shape's dimensional configuration would necessarily affect other cutting parameters.

This relative increase in overall cutting length advantageously yields an increase in the given cutting stream's effective cutting length, namely, the length of that part of the cutting stream's perimeter which actually makes intimate contact with what will become a finished edge of the workpiece being cut. The relative expansion of this effective cutting length enhances the cutting efficiency in numerous ways, as described in preceding paragraphs.

Similar advantages are applicable, of course, to the keyhole-shaped outlet portion configured as illustrated in FIG. 4*p*. The keyhole shape of FIG. 4*p* may also be particularly useful in certain applications, as it tends to wear with use to the teardrop shape shown in FIG. 4*o*.

It is to be understood that FIGS. 4*a*–4*p* represent merely an exemplary set of numerous predetermined configurations which may be adopted for a nozzle member (and orifice component) employed in accordance with the present invention. Numerous variations in sectional shape, orientation, and dimensional extent of the outlet portion, and in its relative position on a given nozzle member (or orifice component) are readily conceivable in accordance with the present invention. Certain outlet portion configurations will obviously be better suited for effecting certain types of cuts, and the choice of particular outlet portion configuration will accordingly be made in view of the cutting task at hand, the cutting control measures available, and other factors pertaining to the given application.

It is to be understood that practical limitations bearing upon the fabrication of nozzle member 20, 20' may inhibit the precision with which certain outlet portion shapes may be formed therein. The shapes shown, therefore, necessarily represent just graphic approximations of the shapes that may actually be realized in practice.

Figure 5:
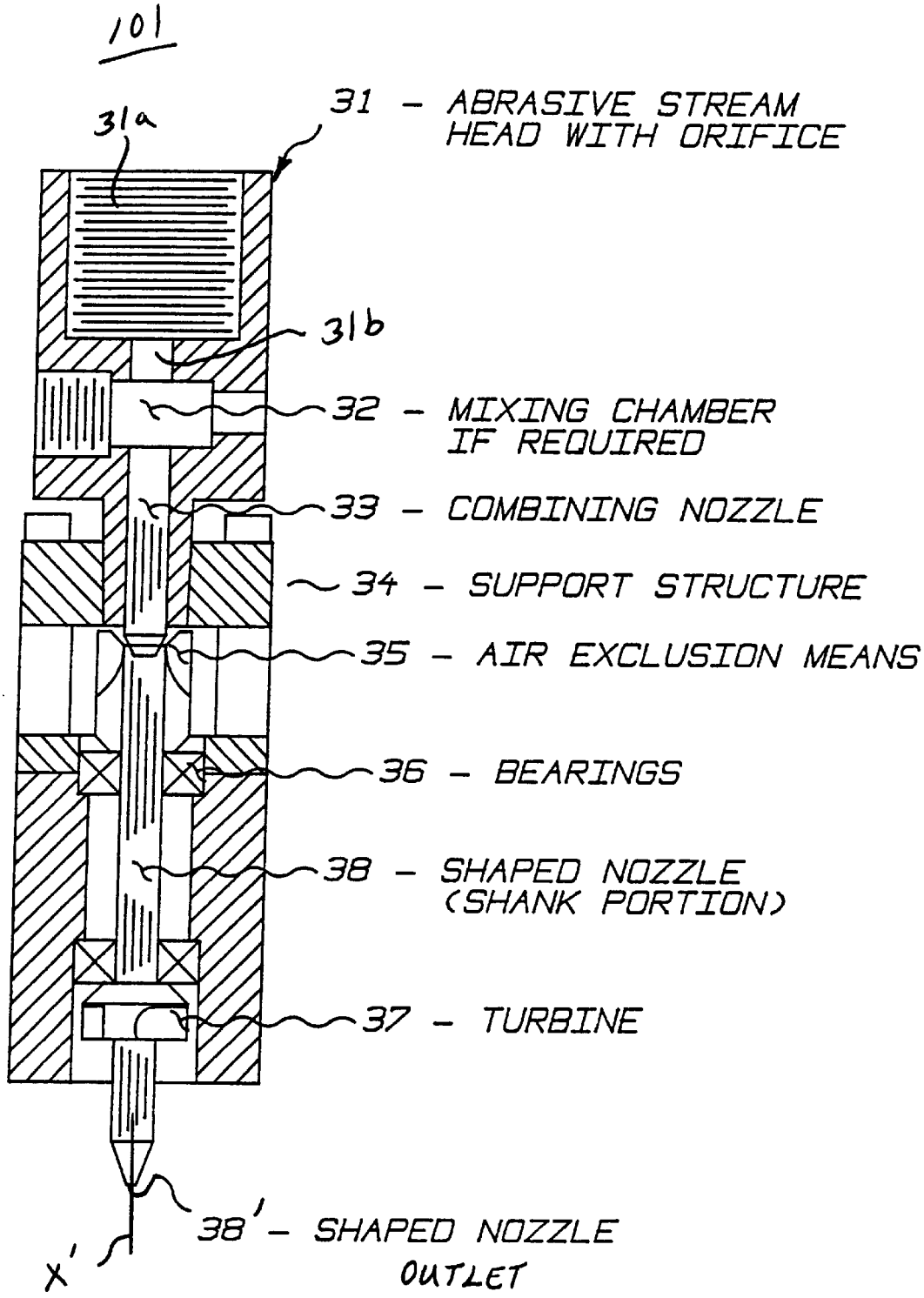
FIG. 5 is a sectional view of a portion of a system implemented in accordance with an exemplary embodiment of the present invention.

Referring to FIG. 5, there is shown a system 101 formed in accordance with an exemplary embodiment of the present invention. System 101 in this embodiment is particularly well suited for precision drilling, boring, trepanning, and other such applications wherein the cutting stream is rotated about a rotation axis to trace out a hole, bore, or other formation greater in surface area than the cutting stream's kerf of cut (which is itself less in diametric extent than the nozzle member). In those applications, the adaptive angular displacement imparted to the nozzle member is typically a continuous yet actively and adaptively controlled rotation for a given period of time about a fixed, predefined rotation axis, so as to trace out a rounded pattern. The traced cut may readily be focused enough that it is less in diametric extent than nozzle member 38. Note, however, that the rotation axis may be controlled during operation to, for instance, dynamically protract the radius of the area being cut.

System 101 generally includes a head assembly 31 to which a nozzling unit formed at least in part by a shaped nozzle member 38 is operably coupled. System 101 also includes an adaptive orientation assembly, which employs a turbine drive member 37 coupled to nozzle member 38, and operates as follows. A high-energy gaseous or liquid fluidic stream is introduced into a threaded entry bore 31*a* of head assembly 31 to then pass through an orifice 31*b* formed in the floor of that entry bore 31*a*. The reduced diameter presented by orifice 31*b* in the path of the high-energy fluidic stream augments the pressure of that stream which next passes through a mixing chamber 32 and enters a combining insert 33. As it travels through mixing chamber 32, the fluidic stream is preferably entrained with a fine, abrasive particulate material. Combining insert 33 channels the abrasive material-laden stream to enter shaped nozzle member 38, serving effectively as a conduit that guides the abrasive laden stream, and as barrier that blocks the downstream migration of abrasive material—which invariably forms a suspended cloud capable of otherwise clogging and cluttering the bearings and other similarly vulnerable components in the system. Combining insert 33 also serves to further mix the fluid and abrasive particle components of the stream, as well as to further polarize the stream. Mixing chamber 32 and combining insert 33 may be realized as either discrete or integrally formed portions of head assembly 31.

As shown, shaped nozzle member 38 is supported in this embodiment by a support structure 34 through which the terminal end of combining insert 33 passes. Shaped nozzle member 38 is supported within this support structure 34 by a plurality of bearings 36 which permit it to be freely displaceable in an angular direction about the rotation axis X'.

It is necessary for proper operation to adequately seal the nozzle-to-combining insert interface. Suitable measures like those employing Ferro fluidic seals (magnetically retained emulsions of oil and iron particles) or other measures remain viable options for ensuring air exclusion; however, a fan unit 35 is preferably employed in the embodiment shown. When it is rotated at high speeds, fan unit 35 serves to reduce the pressure at its axial center, the very region at which the Bernoulli effect of the abrasive laden fluidic stream tends naturally to draw in external air. Fan unit 35 thus operates to counteract the Bernoulli effect and thereby prevent the distortion of the fluidic abrasive stream's form and consequent faults in the cut workpiece's surface finish that might otherwise occur as a result.

System 101 preferably includes a nozzling unit having a nozzle member 38 through which a passage such as passage 28 of FIG. 3*e* terminates at a shaped nozzle outlet portion 38' having a configuration such as shown in FIGS. 4*a*–4*e*. The axis of rotation is preferably defined to coincide with the center axis of shaped nozzle 38. An alternate radial offset in position of the outlet portion 38' would protract the radius about which a cut traced is traced during one full rotation of shaped nozzle member 38.

Nozzle member 38 is equipped with a turbine drive member 37 disposed thereabout which, when actuated by suitable means, serves to responsively rotate nozzle member 38 about the rotation axis. While not shown, any suitable pneumatic, hydraulic, mechanical, electromechanical, electromagnetic, or other known means may be utilized to generate the required actuating force upon turbine drive member 37. For example, hollow shaft electric motors, gear trains, and the like may be used.

While also not shown, suitable control means are preferably incorporated to automatically control turbine drive member 37. Parameters such as the rate, extent, and duration of the shaped nozzle member's angular displacement are actively monitored and adaptively controlled thereby.

Figure 6:
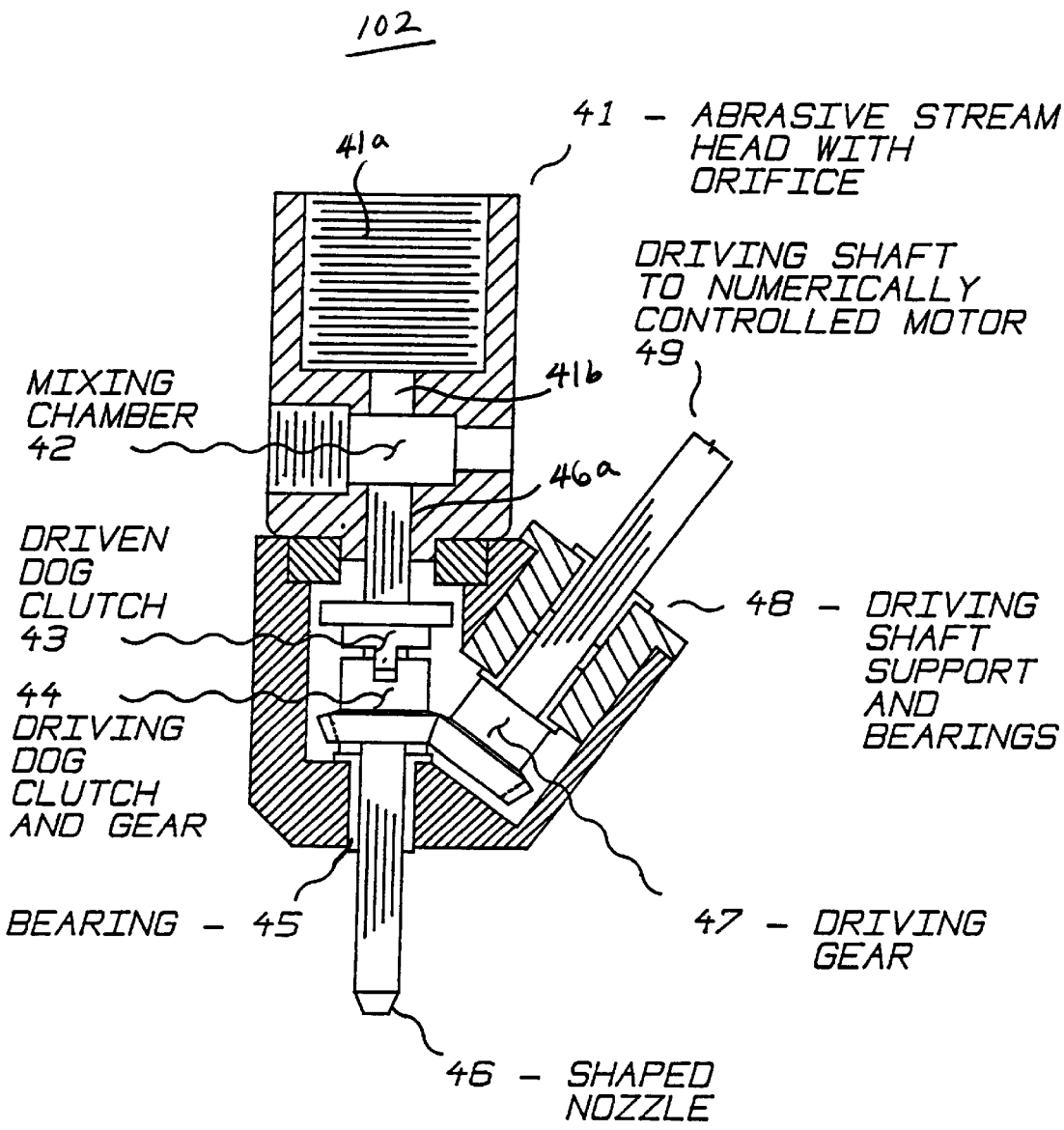
FIG. 6 is a sectional view of a portion of a system implemented in accordance with another exemplary embodiment of the present invention.

Referring next to FIG. 6, there is shown a system 102 formed in accordance with yet another embodiment of the present invention. In this embodiment, active control is again adaptively maintained over the angular position of the cutting stream-expelling nozzle member, but the control maintained may be more complex in nature than maintained, perhaps, in the drilling/trepanning type cutting applications typically carried out by the embodiment of FIG. 5. Particularly well suited for intricate contouring applications wherein the cutting is effected precisely about and along a predefined cut pattern, system 102 continually adjusts the cutting stream to remain in angular orientation (relative to the portion of the predefined pattern then being cut) within a range suitable for the given application. The system does so by angularly displacing the nozzle member in adaptive manner as it is linearly displaced to follow the predefined cut pattern's contour. This necessitates continual coordination of the nozzle member's angular displacement with its linear displacement along the predefined cut pattern's contour. Computer numerical control is preferably employed for this purpose, automatically actuating the nozzle member's angular displacement in programmed manner.

System 102 includes a head assembly 41 that, as in the embodiment of FIG. 5, includes an entry bore 41*a* into which a high-pressure fluid such as water or other suitable liquid or gaseous material is injected. At the floor of this bore 41*a* is formed an orifice 41*b*, the forced passage through which causes the high pressure stream to be further augmented in pressure. Orifice 41*b* leads to a mixing chamber 42 for mixture with an abrasive particulate material and subsequent passage into a nozzling unit. While a combining nozzle structure such as shown in FIG. 5 may alternatively be employed, this embodiment employs an abrasive head assembly 41 configured to receives in press-fit manner an inlet end 46*a* of the nozzling unit's shaped nozzle member 46.

The nozzling unit includes in addition to shaped nozzle member 46 a support structure within which that shaped nozzle member 46 is retained in angularly displaceable manner by a bearing 45. While other embodiments may not employ any clutch mechanisms, the nozzling unit further includes in this embodiment a driving dog clutch and gear portion 44, as well as a driven dog clutch portion 43 engageable therewith. The driven dog clutch portion 43 is fastened to shaped nozzle member 46 preferably in press-fit manner; and, portion 44 is suitably configured to form a slotted engagement with portion 43. Portion 44 is also configured as shown with a toothed gear defined annularly thereon, and slidably disposed with respect to shaped nozzle member 46 for displacement between engaged and disengaged positions. Preferably, a spring or other resilient element is disposed between portions 43 and 44 to resiliently bias driving portion 44 into substantially sealed engagement with driven portion 43.

Engaging the nozzling unit is a driving gear 47 provided upon a driving shaft 49 that is rotatably supported by a support structure and bearings 48. Shaft 49 is preferably coupled to a CNC actuated motor for transferring the angular force generated thereby to adaptively adjust the shaped nozzle member's angular position. When shaped nozzle member 46 is to be angularly displaced, the rotation of driving gear 47 with driving shaft 49 imparts a corresponding rotation upon driving dog clutch and gear portion 44. The engagement of driven dog clutch portion 43 therewith then yields a responsive angular displacement of that driven dog clutch portion 43 which, in turn, rotates shaped nozzle member 46.

Any means using suitable components known in the art may be employed to impart the required angular force upon nozzle member 46. For instance, a belt-driven assembly may alternatively be employed, as may other means mechanically or otherwise engaging nozzle member 46. The present invention is not limited to any particular choice of configuration and mechanism employed for such driving means.

In practice, it is important in this or any other embodiment that the abrasive particulate material introduced at mixing chamber 42 be adequately sealed from gears, clutches, bearings, or any other moving components similarly vulnerable to malfunction and/or destruction if exposed to stray particulate materials. Any suitable measures known in the art may be employed to effect the seals necessary to protect such moving components. Suitable sealing measures would be particularly necessary in those applications where gears, clutches, and the like are purged with pressurized air or water, to prevent the residual flow of that purging air or water, for instance, from entering the mixing chamber 42 of abrasive head assembly 41.

In any event, it is important in accordance with the present invention that the nozzling unit, and particularly shaped nozzle member 46 remain freely displaceable angularly. Thus, it is important that potentially obstructive and constraining connections of nozzle member 46 with cables, feed tubes, and the like be eliminated in favor or those that may readily facilitate the degree of angular displacement contemplated. Where some degree of constraining connection cannot be avoided, it may become necessary for the cutting operation to be interrupted, paused for unwinding of the constraining connection, then restarted to resume the cutting operation. Such interrupted operation tends to degrade the workpiece finish, particularly at the point(s) where the cutting was restarted.

The contouring applications enabled by the embodiment shown make preferable the use of such outlet portion configurations for nozzle member 46 as those shown in FIGS. 4*f*–4*p*. The radial proximity of outlet portion 22, 25 to the nozzle member's center axis in the exemplary configurations there shown (wherein the outlet portion is either centered upon or otherwise encompassing the nozzle member's center axis) tends to minimize the requisite coordination of the nozzle member's angular and linear displacements for appropriate orientation and positioning of the cutting stream relative to the given cut pattern. Preferably, the outlet portion's shape is selected for the optimal degree of fit with the contour to be cut.

Again, it is important in practice to employ suitable measures for preventing the undesirable entry of extraneous air flow into the subject system's fluidic stream, lest a destructive turbulence result therein. Nozzling member 46 in this embodiment fit in preloaded manner with mixing chamber 42 of head assembly 41. Such preloaded fit obviates the use of either the fan employed in the embodiment of FIG. 5 or a comparable sealing material known in the art, such as Ferro fluid.

Figure 7:
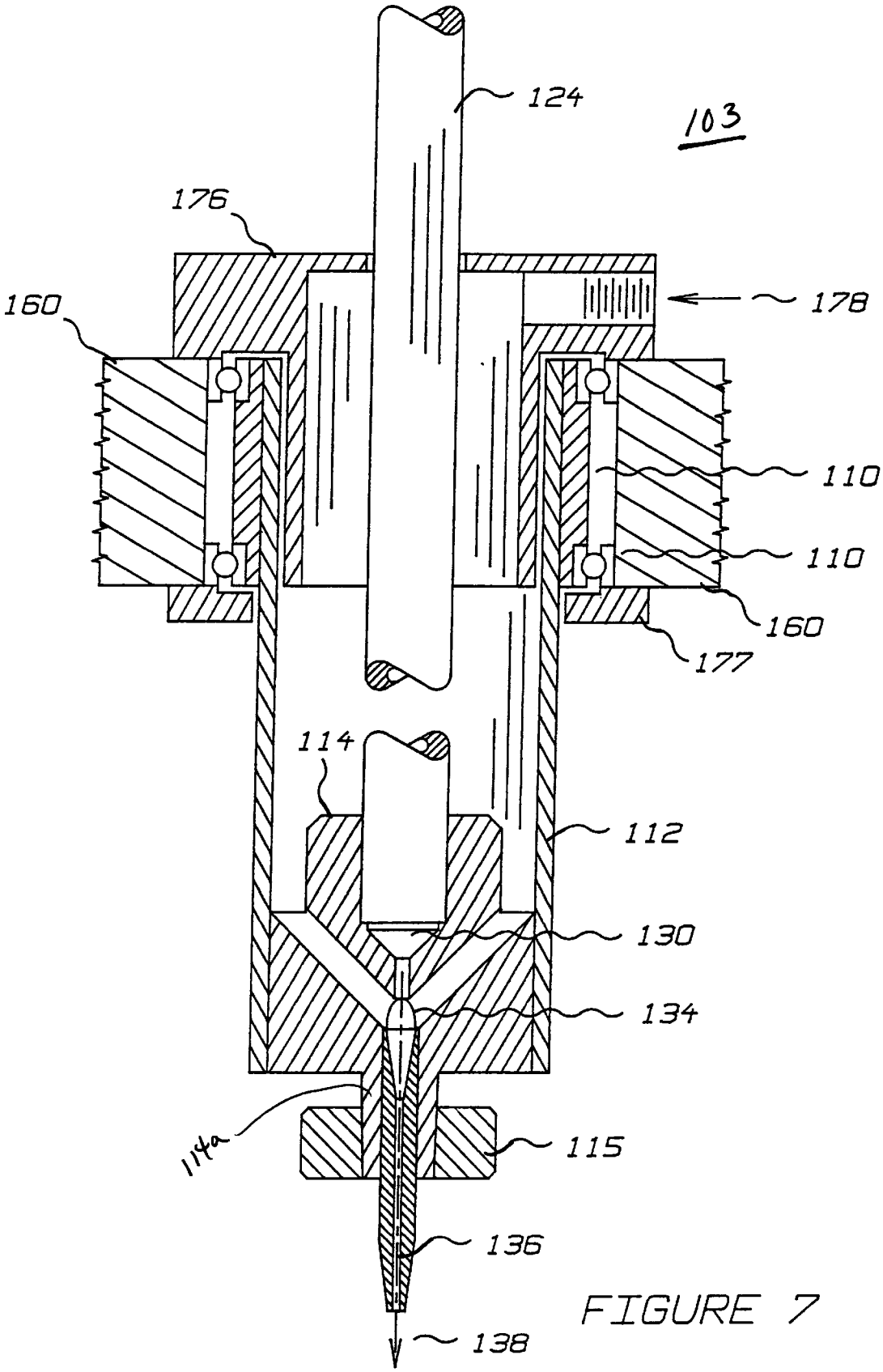
FIG. 7 is a sectional view of a portion of a system implemented in accordance with yet an exemplary embodiment of the present invention.

Referring next to FIG. 7, there is shown a system 103 formed in accordance with still another embodiment of the present invention. In this embodiment, system 103 includes a head assembly, which is itself supported in angularly displaceable manner upon a support frame 160. The head assembly includes an extended length nozzling system having a tubular section 124 disposed within a tubular housing 112. The extended length tubular section 124 is engaged by a bottom closure 114 disposed as shown. The upper end of the tubular section 124 passes through a tubular end section 176 which substantially caps an upper opening of tubular housing 112. A nozzling unit is defined at the bottom end of the disclosed head assembly by a nozzle member having a longitudinally extended passage 136 formed therethrough.

In operation, a high pressure stream of water or other fluid enters from a pressurized upstream source (not shown), and is introduced into tubular section 124 whose lower end is threadedly coupled to bottom closure 114 to capture in sealed manner thereagainst an orifice 130. Passage through orifice 130 accelerates the high pressure fluidic stream to a significantly faster high-energy fluidic stream. A particulate abrasive material is introduced in controlled amounts via a passage 178 formed in tubular end section 176. This particulate abrasive material passes through tubular end section 176 and into tubular housing 112 to pass about the outer periphery of tubular section 124, then through angled peripheral openings formed in bottom closure 114. At point 134, the particulate abrasive material passing through the angled peripheral openings of bottom closure 114 encounter and become entrained within the high-energy fluidic stream passing from orifice 130. The abrasive material laden stream is then nozzled through passage 136 to expel a high-energy abrasive cutting stream 138.

Passage 136 of the nozzling member portion is configured in accordance with the present invention to terminate at an outlet portion having a predetermined sectional shape, such as those shown in FIGS. 4*a*–4*p*, to generate a correspondingly shaped cutting stream 138. The nozzle member portion is securely retained within an adjustable extension 114*a* of bottom closure 114 as shown. This extension 114*a* is preferably formed with an externally threaded split construction such that when it is engaged by a nut 115 as shown, it adjustably constricts responsive to the nut's tightening to grasp the nozzle member in a collet fashion. An equally adjustable and effective capture of the nozzle member may be effected, of course, using any other suitable means known in the art.

Although it is not shown, an adaptive orientation assembly having a motor or other suitable means for angularly displacing the head assembly (and therefore the nozzle member portion) is employed in accordance with the present invention. The head assembly's tubular housing 112 is supported upon support frame 160 via a bearing system 110 to form a swivel structure. This structure, when activated by the adaptive orientation assembly (not shown), swivels with respect to support frame 160 to adjust the nozzle member accordingly in angular orientation.

Figure 8:
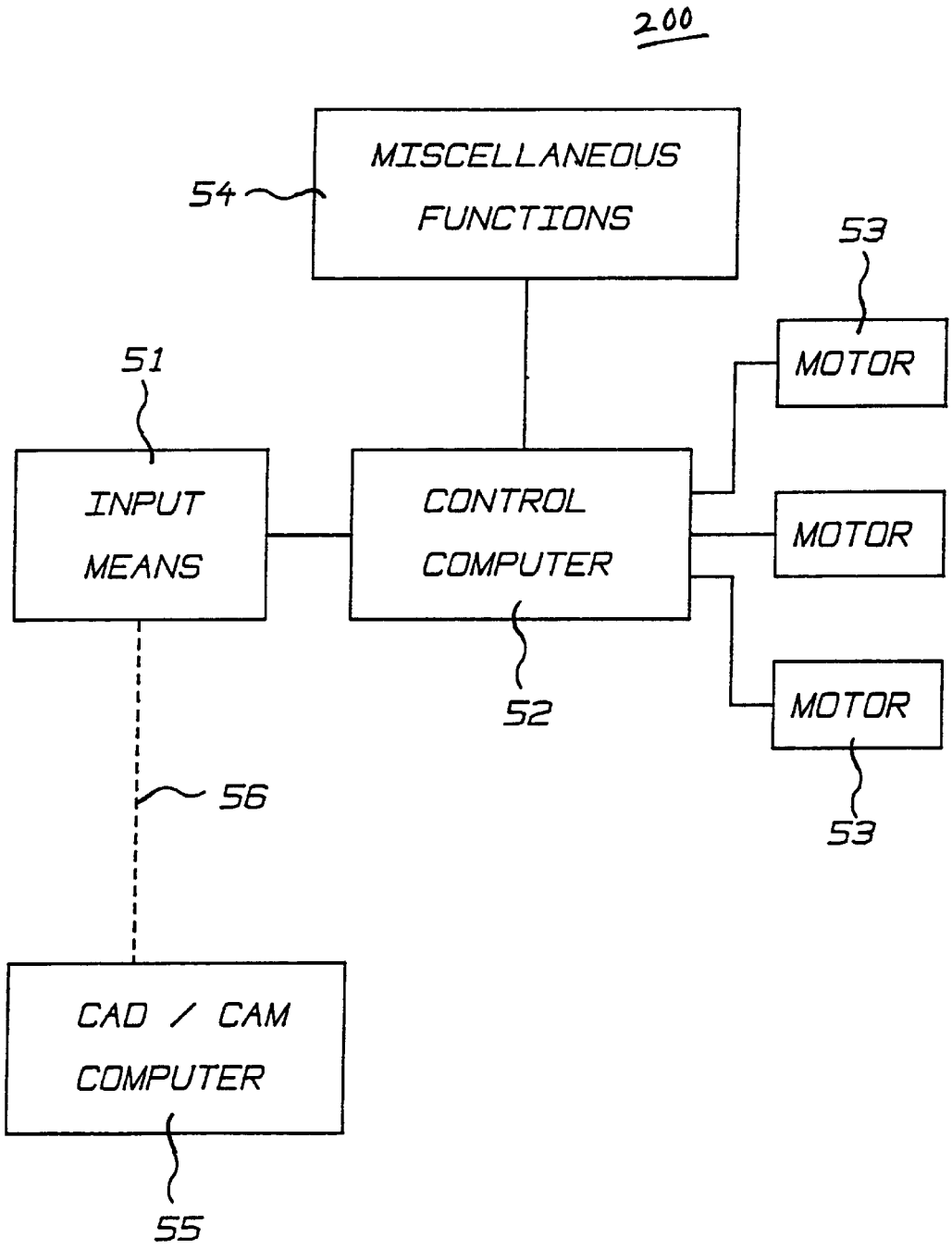
FIG. 8 is a block diagram illustrating the intercoupling of functional components in an exemplary embodiment of a control system employed in accordance with one aspect of the present invention.

Referring to FIG. 8, there is shown a block diagram schematically illustrating the interconnection of functional components for controlling the adaptive displacement of a nozzle member in one embodiment of the present invention. This embodiment is one in which computer numerical control is maintained to automatically actuate a plurality of motors 53 responsive to prevailing system conditions and parameters. Control system 200 includes suitable input means 51 for receiving commands from an operator, from another computer system, or from one or more sensors incorporated, for instance, into a head assembly. Coupled to input means 51 is a control computer 52, which processes with the assistance, in some embodiments, of a programmable logic controller, and generates control signals for motors 53. Control computer 52 also generates control signals for carrying out a plurality of miscellaneous functions required for the intended application.

If the particular requirements of the intended application so require, the control capabilities of control computer 52 may be supplemented by a second computer such as a computer aided drafting (CAD) or computer aided manufacturing (CAM) computer 55. A CAD/CAM computer 55 may serve, for example, to translate certain commands which may not be directly discernible to control computer 52, as programmably configured. In that event, CAD/CAM computer 55 may be operably coupled to input means 51 via an RS-232 serial line, a direct numerical control (DNC) protocol line, or other suitable communication link known in the art. Alternatively, a more static operable coupling such as via a floppy storage disc, may be employed to transfer the pertinent data between CAD/CAM computer 55 and input means 51.

Figure 9:
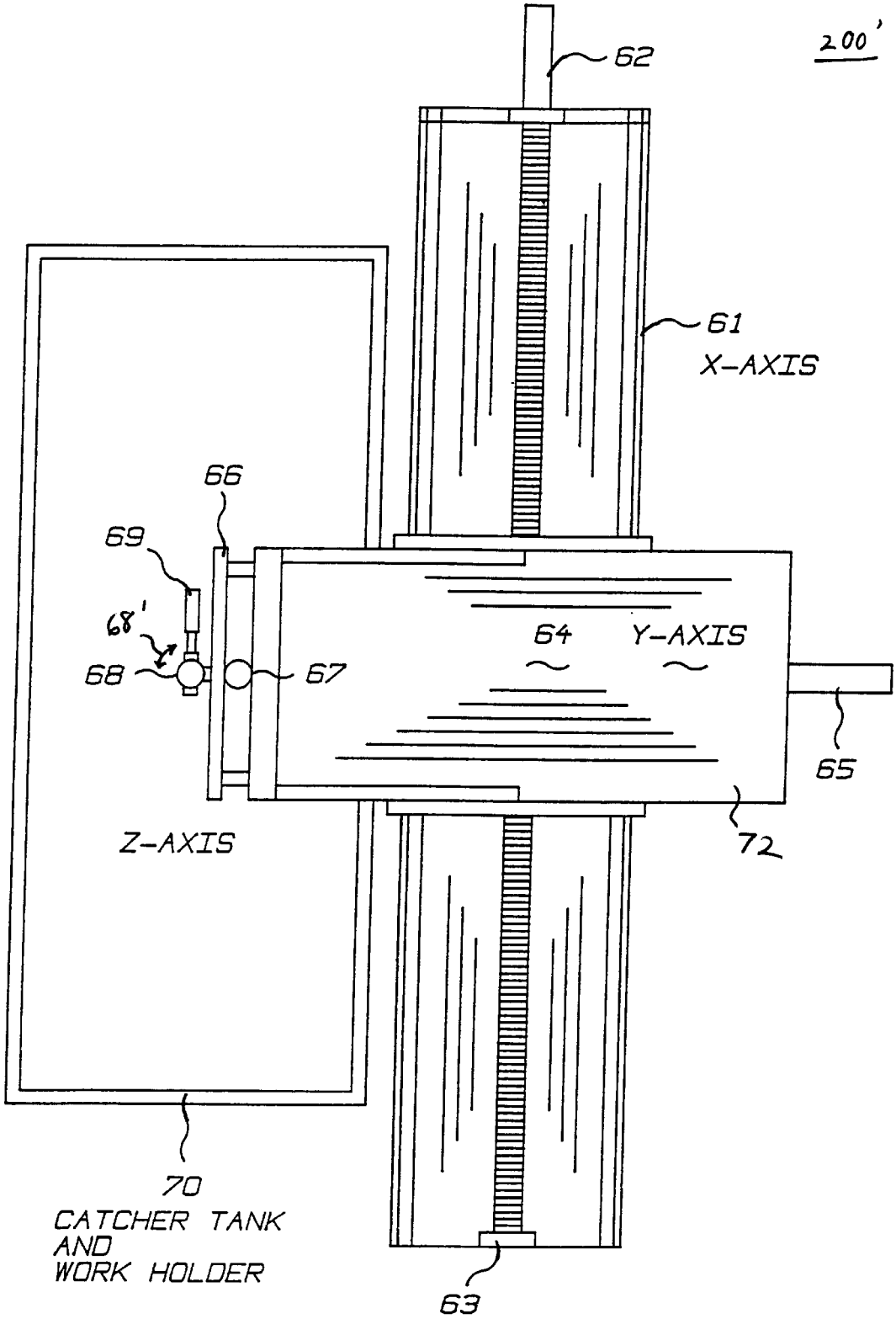
FIG. 9 is a plan view of certain components of an exemplary multi-axis cutting machine for use with a system implemented in accordance with the present invention.

An illustrative embodiment of a computer numerical control machine 200' that may be employed to carrying out the control effected by control system 200 is illustrated in FIG. 9. In this embodiment, CNC machine 200' effects multi-axis control upon a nozzle member coupled to a valve 68 of the type disclosed herein. CNC machine 200' includes an X-axis displacement portion having an X-axis motor 62 which drives an X-axis lead screw 63, or other suitable mechanism. A saddle member 72 is coupled to lead screw 63 for adjustable displacement therealong in the X-axis direction. Saddle member 72 extends to define a Y-axis displacement portion 64 having a Y-motor 65 which drives a lead screw, or other suitable mechanism, extending beneath saddle member 72 in a direction normal to the X-axis.

CNC machine 200' further includes a Z-axis displacement portion 66 to which a nozzle member-supporting high pressure valve 68 is coupled. Z-axis motor 67 drives the linear displacement of valve 68 along the Z-axis defined to extend in a direction normal to both the X- and Y-axes. A separate motor 69 is provided to drive the angular displacement of the nozzle member, as indicated by the directional arrow 68'. The concurrent control of motors 62, 65, 67, and 69 by a CNC control system such as illustrated in FIG. 8 thus enables the desired cutting of a workpiece supported upon a tank and work holder 70.

Note that in alternate embodiments, a further degree of freedom may be realized, for instance, by articulating either the nozzle member and/or valve 68 pivotally about one or more pivot axes extending in a direction parallel to the Y-axis. Preferably, the pivot axis in that event is defined to extend transversely from a point along the length of the nozzle member or valve 68 being articulated.

While relative displacement between the cutting stream-expelling nozzling unit (or nozzle member/orifice component) and workpiece is described for clarity herein as being effected by the displacement of the nozzling unit with a fixed workpiece, such relative displacement may be effected in converse manner. It is certainly conceivable, in the alternative, to appropriately displace the workpiece itself relative to a fixed nozzling unit. It is likewise conceivable, where necessary, to relatively displace in combination both the workpiece and nozzling unit.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular combinations of system control steps may be reversed or interposed, all without departing from the spirit or scope of the invention as defined in the appended claims.

What is claimed is:

1. A system for delivering onto a workpiece a high-energy abrasive cutting stream comprising:

(a) a head assembly for generating a pressurized fluidic stream;

(b) a nozzling unit coupled to said head assembly fox nozzling said pressurized fluidic stream to expel a high-energy abrasive cuffing stream for advancing and cutting along a predefined pattern on the workpiece, said nozzling unit including a nozzle member having a laminar inner wall surface defining a longitudinal passage, said passage terminating at an outlet portion describing in sectional contour a predetermined shape to generate upon the workpiece an instantaneous kerf of cut having a corresponding sectional contour; and, (c) an adaptive orientation assembly coupled to said nozzling unit for angularly displacing said nozzle member during the advancement of said high-energy abrasive cutting stream along said predefined pattern on the workpiece in a manner adaptive to the position of said nozzling unit relative to said predefined pattern, said adaptive orientation assembly maintaining the instantaneous kerf of cut within a predefined angular orientation range relative to said predefined pattern.

2. A system for delivering onto a workpiece a high-energy abrasive cutting stream comprising;

(a) a head assembly for generating a pressurized fluidic stream;

(b) a nozzling unit coupled to said head assembly for nozzling said pressurized fluidic stream to expel a high-energy abrasive cutting stream for cutting along a predefined pattern on the workpiece, said nozzling unit including a nozzle member having a laminar inner wall surface defining a longitudinal passage, said passage terminating at an outlet portion describing in sectional contour a predetermined shape to generate upon the workpiece an instantaneous kerf of cut having a corresponding sectional contour;

(c) an adaptive orientation assembly coupled to said nozzling unit for angularly displacing said nozzle member in a manner adaptive to the position of said nozzling unit relative to said pattern predefined on the workpiece, said adaptive orientation assembly maintaining the instantaneous kerf of cut within a predefined angular orientation range relative to said predefined pattern; and, (d) an articulation assembly coupled to said nozzling unit for pivotally displacing said nozzle member about a transversely directed pivot axis during said relative displacement of said nozzling unit and workpiece.

3. The system as recited in claim 1 further comprising a controller coupled to said adaptive orientation assembly for automatically actuating said adaptive angular displacement of said nozzle member.

4. The system as recited in claim 3 wherein said controller includes a multi-axis computer numerical control machine.

5. The system as recited in claim 1 wherein said nozzle member extends along an angular orientation axis, said adaptive orientation assembly angularly displacing said nozzle member about said angular orientation axis.

6. The system as recited in claim 5 wherein said passage of said nozzle member extends in coaxial manner relative to said angular orientation axis.

7. The system as recited in claim 6 wherein said predetermined shape is a non-circular shape selected from the group consisting of: square, rectangular, curved rectangular, elliptic, segmented annular, diamond-like, oval, oblong, curved oblong, teardrop-like, and keyhole-like shapes.

8. The system as recited in claim 5 wherein said passage of said nozzle member extends in non-coaxial manner relative to said angular orientation axis.

9. The system as recited in claim 8 wherein said predetermined shape is selected from the group consisting of: circular, square, rectangular, curved rectangular, elliptic, segmented annular, diamond-like, oval, oblong, curved oblong, teardrop-like, and keyhole-like shapes.

10. The system as recited in claim 1 wherein said adaptive orientation assembly includes a motorized drive mechanism coupled to said nozzling unit for imparting said angular displacement thereto.

11. The system as recited in claim 10 wherein said motorized drive mechanism includes a gear engaged coupling portion.

12. The system as recited in claim 1 wherein said passage includes an inlet portion describing in sectional contour an entry shape incongruent to said predetermined shape of said outlet portion.

13. The system as recited in claim 1 wherein said predetermined shape defines dimensional length and width extents related by a ratio of at least 1.5 in value.

14. The system as recited in claim 1 wherein said nozzle member forms an orifice device.

15. The system as recited in claim 1 wherein said nozzle member is integrally formed.

16. A water jet system for delivering onto a workpiece a high definition abrasive cutting stream comprising:

(a) a head assembly for generating a pressurized fluidic stream having a particulate abrasive material suspended therein;

(b) a nozzling unit coupled to said head assembly for nozzling said pressurized fluidic stream to expel a high-energy abrasive cutting stream for advancing and cutting along a predefined pattern on the workpiece, said nozzling unit including a nozzle member extending along an angular orientation axis, said nozzle member having a laminar inner wall surface defining a longitudinally extended passage, said passage having distal inlet and outlet portions respectively describing in sectional contour incongruent inlet and outlet shapes, said outlet portion passing the high-energy abrasive cutting stream to generate upon the workpiece an instantaneous kerf of cut having a corresponding sectional contour;

(c) an adaptive orientation assembly coupled to said nozzling unit for angularly displacing said nozzle member about said angular orientation axis during the advancement of said high-energy abrasive cutting stream along said predefined pattern on the workpiece in a manner adaptive to displacement of said nozzling unit and workpiece one relative to the other, said adaptive orientation assembly maintaining the instantaneous kerf of cut within a predefined angular orientation range relative to said predefined pattern; and, (d) a controller coupled to said adaptive orientation assembly for automatically actuating said adaptive angular displacement of said nozzle member.

17. A water jet system for delivering onto a workpiece a high definition abrasive cutting stream comprising:

(a) a head assembly for generating a pressurized fluidic stream having a particulate abrasive material suspended therein;

(b) a nozzling unit coupled to said head assembly for nozzling said pressurized fluidic stream to expel a high-energy abrasive cutting stream for cutting along a predefined pattern on the workpiece, said nozzling unit including a nozzle member extending along an angular orientation axis, said nozzle member having a laminar inner wall surface defining a longitudinally extended passage, said passage having distal inlet and outlet portions respectively describing in sectional contour incongruent inlet and outlet shapes, said outlet portion passing the high-energy abrasive cutting stream to generate upon the workpiece an instantaneous kerf of cut having a corresponding sectional contour;

(c) an adaptive orientation assembly coupled to said nozzling unit for angularly displacing said nozzle member about said angular orientation axis in a manner adaptive to displacement of said nozzling unit and workpiece one relative to the other, said adaptive orientation assembly maintaining the instantaneous kerf of cut within a predefined angular orientation range relative to said predefined pattern;

(d) a controller coupled to said adaptive orientation assembly for automatically actuating said adaptive angular displacement of said nozzle member; and, (e) an articulation assembly coupled to said nozzle unit for pivotally displacing said nozzle member about a transversely directed pivot axis during said relative displacement of said nozzling unit and workpiece.

18. The water jet system as recited in claim 16 wherein said outlet shape is a non-circular shape selected from the group consisting of: square, rectangular, curved rectangular, elliptic, segmented annular, diamond-like, oval, oblong, curved oblong, teardrop-like, and keyhole-like shapes.

19. The water jet system as recited in claim 18 wherein said passage of said nozzle member extends in coaxial manner relative to said angular orientation axis.

20. The water jet system as recited in claim 18 wherein said passage of said nozzle member extends in non-coaxial manner relative to said angular orientation axis.

21. The water jet system as recited in claim 16 wherein said adaptive orientation assembly includes a motorized drive mechanism coupled to said nozzling unit for imparting said angular displacement thereto.

22. The water jet system as recited in claim 21 wherein said motorized drive mechanism includes a gear engaged coupling portion.

23. The water jet system as recited in claim 21 wherein said controller includes a multi-axis computer numerical control machine operable to automatically actuate said motorized drive mechanism.

24. The water jet system as recited in claim 16 wherein said predetermined shape defines dimensional length and width extents related by a ratio of at least 1.5 in value.

25. A method of delivering onto a workpiece a high-energy abrasive cutting stream comprising the steps of:

(a) establishing a nozzling unit including a nozzle member extending along an angular orientation axis and having a laminar inner wall surface defining a longitudinally extended passage therethrough, said passage terminating at an outlet portion describing in sectional contour a predetermined shape;

(b) compressing a fluid and combining therewith an abrasive particulate material to generate a pressurized fluidic stream;

(c) nozzling said pressurized fluidic stream through said nozzling unit to expel a high-energy abrasive cutting stream for advancing and cuffing along a predefined pattern on the workpiece, said high-energy abrasive cutting stream generating upon the workpiece an instantaneous kerf of cut having a sectional contour corresponding to said predetermined shape;

(d) displacing said nozzling unit and workpiece one relative to the other to progressively cut along said predefined pattern on the workpiece; and, (e) automatically maintaining the instantaneous kerf of cut within a predefined angular orientation range relative to said predefined pattern by angularly displacing said nozzle member about said angular orientation axis during the advancement of said high-energy abrasive cutting stream along said predefined pattern on the workpiece in a manner adaptive to the position of said nozzling unit relative to said predefined pattern.

26. A method of delivering onto a workpiece a high-energy abrasive cutting stream comprising the steps of:

(a) establishing a nozzling unit including a nozzle member extending along an angular orientation axis and having a laminar inner wall surface defining a longitudinally extended passage therethrough, said passage terminating at an outlet portion describing in sectional contour a predetermined shape;

(b) compressing a fluid and combining therewith an abrasive particulate material to generate a pressurized fluidic stream;

(c) nozzling said pressurized fluidic stream through said nozzling unit to expel a high-energy abrasive cutting stream for cutting along a predefined pattern on the workpiece, said high-energy abrasive cutting stream generating upon the workpiece an instantaneous kerf of cut having a sectional contour corresponding to said predetermined shape;

(d) displacing said nozzling unit and workpiece one relative to the other to progressively cut along said predefined pattern on the workpiece;

(e) automatically maintaining the instantaneous kerf of cut within a predefined angular orientation range relative to said predefined pattern by angularly displacing said nozzle member about said angular orientation axis in a manner adaptive to the position of said nozzling unit relative to said pattern predefined on the workpiece; and, (f) articulating said nozzle unit for pivotally displacing said nozzle member about a transversely directed pivot axis.

27. The method as recited in claim 25 wherein said predetermined shape is a non-circular shape selected from the group consisting of: square, rectangular, curved rectangular, elliptic, segmented annular, diamond-like, oval, oblong, curved oblong, teardrop-like, and keyhole-like shapes.

28. The method as recited in claim 27 wherein said passage of said nozzle member is established to extend coaxially relative to said angular orientation axis.

29. The method as recited in claim 27 wherein said passage of said nozzle member is established to extend non-coaxially relative to said angular orientation axis.

30. The method as recited in claim 27 wherein said programmable controller executes computer numerical control over said angular displacement of said nozzle member.

31. The method as recited in claim 25 wherein the instantaneous kerf of cut generated by said high-energy abrasive cutting stream defines dimensional length and width extents related by a ratio of at least 1.5 in value.

* * * * *